United States Patent [19]

Brinkman

[11] Patent Number: 4,577,869

[45] Date of Patent: Mar. 25, 1986

[54] PROMOTIONAL GAME

[76] Inventor: Winford L. Brinkman, 20135 S. Greenway, Southfield, Mich. 48076

[21] Appl. No.: 697,565

[22] Filed: Feb. 1, 1985

[51] Int. Cl.[4] ..... A63F 3/00

[52] U.S. Cl. ..... 273/269; 273/139; 273/273

[58] Field of Search ..... 273/139, 269, 271, 273, 273/284; 283/100, 101, 102, 105; D21/32, 35

[56] References Cited

U.S. PATENT DOCUMENTS

| | | | |
|---|---|---|---|
| D. 89,781 | 5/1933 | Manos | D21/32 X |
| 572,388 | 12/1896 | Kuran | 273/271 X |
| 1,359,646 | 11/1920 | Zion | 273/273 X |
| 3,588,113 | 6/1971 | Nelson | 273/271 |
| 3,940,124 | 2/1976 | Johnsen | 283/100 X |

OTHER PUBLICATIONS

Affidavit of H. Skogquist concerning "Safeway" Bingo Game, Nov. 1985.

*Primary Examiner*—Harland S. Skogquist
*Attorney, Agent, or Firm*—Brooks & Kushman

[57] ABSTRACT

A promotional game disclosed includes a game card (10) having concentric first and second sets of circular indicia (14 and 16) and a third set of radially extending indicia (18) spaced angularly from each other. Each set of indicia (14, 16 and 18) includes at least one series of distinctive markings. Game tickets (22) of the game have selected indicia corresponding to the indicia of the first, second, and third sets such that a prize is won by matching tickets with the markings of any series of indicia on the game card. Slits (28) in the game card (10) permit securement of the game tickets (22) to the game card over the appropriate markings.

10 Claims, 4 Drawing Figures

PROMOTIONAL GAME

TECHNICAL FIELD

This invention relates to a promotional game which has particular utility for use in the supermarket industry in connection with the sale of food and other related and unrelated items.

BACKGROUND ART

Promotional games have previously been utilized in the supermarket industry to increase sales. Conventional promotional games include a game card on which a bingo type square of numbers or letters is provided with or without one or more straight line arrangement of numbers or letters. Game tickets usually given in packets at the point of sale have selected numbers and/or letters matching the numbers and/or letters on the game card. Prizes are won by matching tickets with selected arrangements of numbers and/or letters on the card in accordance with the game rules which are printed on the card. Normally there are a limited number of game tickets sold for matching one number or letter of each prize so that the game does not become too costly to the supermarket owner. It is conventional to provide an "odds chart" listing the number of each prizes that can be won in accordance with the limited number of tickets provided for each prize.

While the conventional supermarket promotional game described above using bingo type squares and straight line arrangements of numbers and/or letters does increase sales, such games have lost their novelty since the initial introduction and no longer promote the interest that was initially present when first introduced.

DISCLOSURE OF INVENTION

An object of the present invention is to provide an improved promotional game that has particular utility in connection with the supermarket industry.

In carrying out the above object, the promotional game of the invention includes a game card having a first set of indicia arranged in a circular shape and also having a second set of indicia arranged in a circular shape around the first set of indicia in a concentric relationship. A third set of indicia is also provided on the game card extending radially between the first and second sets of indicia at angularly spaced locations from each other. Each set of indicia includes at least one series of distinctive markings for use in playing the game. Game tickets of the game are given to the customer at the point of sale and have selected indicia corresponding to the indicia of the first, second, and third sets such that a prize is won by matching tickets with the markings of any series of indicia on the game card. A suitable means preferably embodied by slits in the card provide for securement of the game tickets to the game card over the appropriate markings to provide ease in determining whether a prize has been won.

In the preferred embodiment of the promotional game, the first set of indicia on the game card includes a plurality of series of two digit numbers extending circumferentially between the angularly spaced radially extending indicia of the third set. The second set of indicia preferably includes a plurality of series of three digit numbers also extending circumferentially between the angularly spaced radially extending indicia of the third set.

Between the first and second sets of circumferentially extending series of two and three digit numbers of the first and second sets, the third set of indicia preferably includes series of letters forming radially extending words and further includes a series of letters forming a circular word located within the first set of indicia and having certain letters shared with the inwardmost letters of the radially extending words. The game card also includes arrows that point in a radial inward direction and provide a background for the radially extending words of the third set of indicia. A central inner circle toward which the arrows point is also provided on the game card and provides a convenient location for indicating the grand prize that can be won by playing the game.

The objects, features, and advantages of the present invention are readily apparent from the following detailed description of the best mode for carrying out the invention when taken in connection with the accompanying drawings.

BEST MODE FOR CARRYING OUT THE INVENTION

Figure 1:
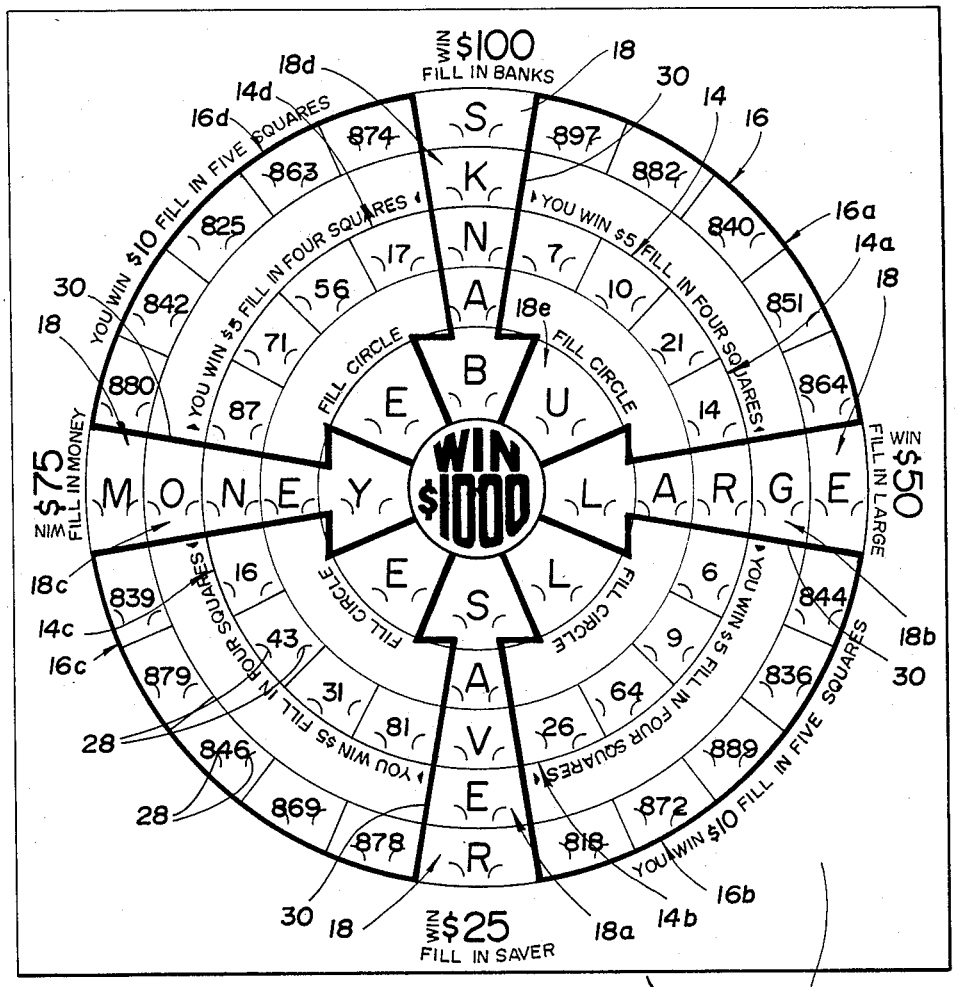
FIG. 1 is a plan view of a game card of a promotional game constructed in accordance with the present invention.
Figure 2:
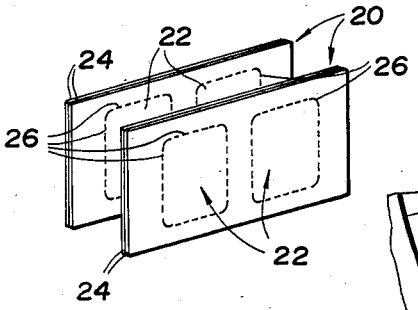
FIG. 2 is a perspective view of unopened game ticket packets of the promotional game.

With reference to the drawings, a promotional game according to the present invention includes a game card 10 that can be conveniently made of paper or cardboard with a playing surface 12 having printed indicia used in playing the game. The playing surface 12 of the card includes a first set of indicia 14 arranged in a circular shape and also includes a second set of indicia 16 arranged in a circular shape around the first set of indicia in a concentric relationship. A third set of indicia 18 is also provided on the playing surface 12 of the game card 10 extending radially between the first and second sets of indicia 14 and 16 at angularly spaced locations from each other. Each of the sets of indicia 14, 16, and 18 includes at least one series of distinctive markings used in playing the game.

Figure 3:
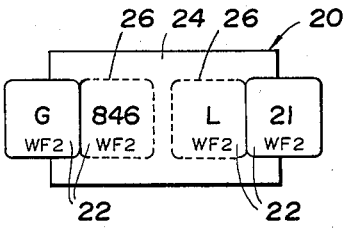
FIG. 3 is a plan view of one of the game ticket packets after opening thereof to expose game tickets used in playing the game.
Figure 4:
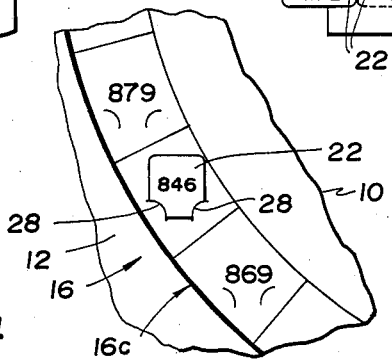
FIG. 4 is a partial view of the game card illustrating the manner in which one of the game tickets is secured to the card.

As illustrated in FIGS. 3 and 4, the promotional game also includes ticket packets 20 which include tickets 22 used in playing the game. Each ticket packet is made of two cardboard layers 24 with two tickets 22 defined on each layer by edge perforations 26. The tickets have a generally rectangular shape with rounded corners and have printed indicia on their inwardly facing surfaces such that the indicia is hidden from sight prior to opening. Manual opening of the ticket packets is performed by severing the tickets 22 at the perforations 26. The indicia on the tickets 24 is selected to correspond to selected indicia of the first, second, and third sets of indicia 14, 16, and 18 on the playing surface 12 of the game card 10. In addition, the lower edges of the indicia are also provided with a code number, e.g. WF2, that indicates the applicable time and location for the game so as to permit the game to be utilized more than once at different times and locations without the ticket from one game time and location being applicable to any other.

As illustrated in FIG. 4, a game ticket 22 removed from the ticket packet is secured to the game card 10 by insertion into a pair of curved slits 28 in the card. These curved slits 28 form a pocket which provides an preferred means for securing the game tickets 22 to the card over the appropriate marking and thereby faciliate the game player in providing an indication of whether a prize has been won.

As illustrated in FIG. 1, the first set of indicia 14 preferably includes a plurality of series of two digit numbers 14*a*, 14*b*, 14*c*, and 14*d* extending circumferentially between the angularly spaced radially extending indicia of the third set 18. These four series of two digit numbers thus each extend circumferentially just slightly less than 90 degrees by an amount equal to the spacing of one of the adjacent series of distinctive markings of the third set of indicia 18.

With continuing reference to FIG. 1, the second set of indicia 16 includes a plurality of series of three digit numbers 16*a*, 16*b*, 16*c*, and 16*d* extending circumferentially between the angularly spaced radially extending indicia of the third set 18. These four series of three digit numbers like the four series of two digit numbers each extend circumferentially just slightly less than 90 degrees by an amount equal to the spacing of one of the adjacent series of distinctive markings of the third set of indicia 18.

The third set of indicia 18 illustrated in FIG. 1 includes series of letters 18*a*, 18*b*, 18*c*, and 18*d* forming the words: SAVER, LARGE, MONEY, and BANKS. These words extend radially with respect to the first and second sets of circular indicia 14 and 16 between the series of numbers of each. The third set of indicia 18 also includes a series of letters 18*e* forming the circular word BULLSEYE located within the first set of circular indicia 14 with the letters S, L, Y, and B thereof shared with the inwardmost letters of the radially extending words SAVER, LARGE, MONEY, and BANKS.

The third set of indicia 18 on the playing card surface 12 also preferably includes arrows 30 that point in a radial inward direction and provide a background for the radially extending words. A central inner circle 32 is also provided on the playing surface 12 of the game card 10 to provide an indication of the grand prize that can be won playing the game.

Written indications are also provided on the game card playing surface 12 of the prizes that are won for matching tickets with each series of indicia. For example, a $5 prize is won with each two digit series of numbers, a $10 prize is won with each three digit series of numbers, $25, $50, $75, and $100 prizes are won for the radially words, and the $1000 grand prize is won for the central circular word.

While the best mode for carrying out the invention has been described in detail, those familiar with the art to which this invention relates will recognize alternative ways of practicing the invention as defined by the following claims.

What is claimed:

1. A promotional game comprising: a game card having a first set of indicia arranged in a circular shape; a second set of indicia arranged on the game card in a circular shape around the first set of indicia in a concentric relationship; a third set of indicia on the game card extending radially between the first and second sets of indicia at angularly spaced locations from each other; each set of indicia including at least one series of distinctive markings; game tickets having selected indicia corresponding to the indicia of the first, second, and third sets such that a prize is won by matching tickets with the markings of any series of indicia on the game card; and means for securing the game tickets to the card over the appropriate markings.

2. A promotional game as in claim 1 wherein the first set of indicia includes a plurality of series of two digit numbers extending circumferentially between the angularly spaced radially extending indicia of the third set.

3. A promotional game as in claim 1 wherein the second set of indicia includes a plurality of series of three digit numbers extending circumferentially between the angularly spaced radially extending indicia of the third set.

4. A promotional game as in claim 1 wherein the third set of indicia includes series of letters forming radially extending words and further includes a series of letters forming a circular word within located the first set of indicia and having certain letters shared with the inwardmost letters of the radially extending words.

5. A promotional game as in claim 4 wherein the third set of indicia includes arrows that point in a radial inward direction and provide a background for the radially extending words.

6. A promotional game as in claim 5 wherein the game card also includes a central inner circle toward which the arrows point.

7. A promotional game as in claim 1 further including ticket packets each of which includes a plurality of the game tickets.

8. A promotional game as in claim 1 wherein the means for securing the game tickets comprises slits cut into the game card.

9. A promotional game comprising: a game card having a first set of indicia including a plurality of series of two digit numbers arranged to cooperatively define a circular shape; a second set of indicia including a plurality of series of three digit numbers arranged on the game card to cooperatively define a circular shape around the first set of indicia in a concentric relationship; a third set of indicia including series of letters forming words extending radially on the game card between the first and second sets of indicia at angularly spaced locations from each other between the series of numbers of both the first and second sets of indicia; the third set of indicia also including a series of letters forming a circular word on the game card within the first set of indicia and having certain letters shared with the inwardmost letters of the radially extending words; game tickets having selected indicia corresponding to the numbers and letters of the first, second, and third sets such that a prize is won by matching tickets with the numbers or letters of any series of indicia on the game card; and means for securing the game tickets to the card over the appropriate number or letter.

10. A promotional game comprising: a game card having a first set of indicia including four series of two digit numbers arranged to cooperatively define a circular shape; a second set of indicia including four series of three digit number arranged on the game card to cooperatively define a circular shape around the first set of indicia in a concentric relationship; a third set of indicia including four series of letters forming words extending radially on the game card between the first and second sets of indicia at angularly spaced locations from each other between the four series of numbers of both the first and second sets of indicia; the third set of indicia also including a series of letters forming a circular word within the first set of indicia and having certain letters shared with the inwardmost letters of the radially extending words; ticket packets each of which includes a plurality of game tickets having selected indicia corresponding to the numbers and letters of the first, second, and third sets such that a prize is won by matching tickets with the numbers or letters of any series of indicia; and slits in the card for securing the game tickets to the card over the appropriate number or letter.

* * * * *